United States Patent [19]

Mowbray

[11] 4,446,835

[45] May 8, 1984

[54] LIQUID FUEL INJECTION PUMPING APPARATUS

[75] Inventor: Dorian F. Mowbray, Burnham, England

[73] Assignee: Lucas Industries Limited, Birmingham, England

[21] Appl. No.: 315,514

[22] Filed: Oct. 27, 1981

[30] Foreign Application Priority Data

Dec. 31, 1980 [GB] United Kingdom ..... 8041547

[51] Int. Cl.[3] ..... F02M 59/28; F04B 1/06

[52] U.S. Cl. ..... 123/450; 123/387; 123/179 L; 123/198 F; 417/462

[58] Field of Search ..... 123/450, 387, 385, 386, 123/179 L, 198 F; 417/462, 221, 222

[56] References Cited

U.S. PATENT DOCUMENTS

| | | | |
|---|---|---|---|
| 3,847,509 | 11/1974 | Bonin | 417/462 |
| 4,098,249 | 7/1978 | Mowbray | 123/450 |
| 4,292,012 | 9/1981 | Brotherston | 417/462 |
| 4,334,831 | 6/1982 | Baxter | 417/462 |
| 4,348,163 | 9/1982 | Gilbert | 417/462 |
| 4,358,255 | 11/1982 | Brotherston | 417/462 |
| 4,362,140 | 12/1982 | Jefferson | 417/462 |
| 4,397,615 | 8/1983 | Mowbray | 417/462 |
| 4,401,084 | 8/1983 | Jarrett | 123/450 |

*Primary Examiner*—Charles J. Myhre
*Assistant Examiner*—Carl Stuart Miller

[57] ABSTRACT

A liquid fuel injection pumping apparatus of the rotary distributor type has stop means defined by complementary inclined surfaces on a rotary portion, coupled to a drive shaft and on the cam followers associated with the pumping plungers. The cam followers and the distributor member are axially movable to vary fuel quantity. In order to vary the initial rate of fuel delivery one or a reduced number of plungers only is arranged to deliver the initial flow of fuel. This is achieved by axial adjustment of one or more cam followers relative to the distributor member so that the associated plunger or plungers can move outwardly further during the filling stroke of the apparatus and will therefore be moved inwardly before the remaining plungers. Alternatively an axially movable part may be provided on said rotary portion.

3 Claims, 5 Drawing Figures

LIQUID FUEL INJECTION PUMPING APPARATUS

This invention relates to a liquid fuel injection pumping apparatus for supplying fuel to an internal combustion engine and of the kind comprising a body part, a rotary distributor member mounted in the body part and arranged in use to be driven in timed relationship with the associated engine, bores formed in the distributor member, plungers in said bores respectively, cam followers positioned at the outer ends of said plungers respectively for engagement with cam lobes formed on the internal surface of a cam ring surrounding the distributor member, passage means for conveying fuel to and from said bore during rotation of the distributor member, stop means for limiting the outward movement of the plungers, said stop means comprising complementary inclined surfaces on the followers and a portion rotatable with the distributor member, and means for adjusting the axial setting of the distributor member within the body part whereby the amount of fuel which can be delivered by the apparatus during inward movement of the plungers can be varied.

In a known form of such an apparatus as described in British Patent Specification No. 2037365, the plungers are of the same diameter and the complementary surfaces on the part and followers have the same shape and are similarly positioned. Both plungers therefore start their inward movement at the same time. The rate of delivery of fuel considered in terms of rotation of the distributor member, is therefore dictated only by the shape of the leading flanks of the cam lobes.

With some engines it is desirable that the initial rate of fuel delivery to the engine should be at a reduced rate in order to ensure smoother operation of the engine. A reduction of the initial rate of fuel delivery can be obtained by arranging that one plunger is moved inwardly before the other however, it is also desirable that the quantity of fuel delivered at the low rate should vary with the speed at which the engine is operating and the object of the present invention is to provide an apparatus of the kind specified in which this desideratum is achieved.

According to the invention in an apparatus of the kind specified a part associated with one of said plungers and which defines one of said complementary surfaces is axially movable, and further means responsive to the speed of operation of the apparatus is provided to vary the axial position of said member.

Figure 1:
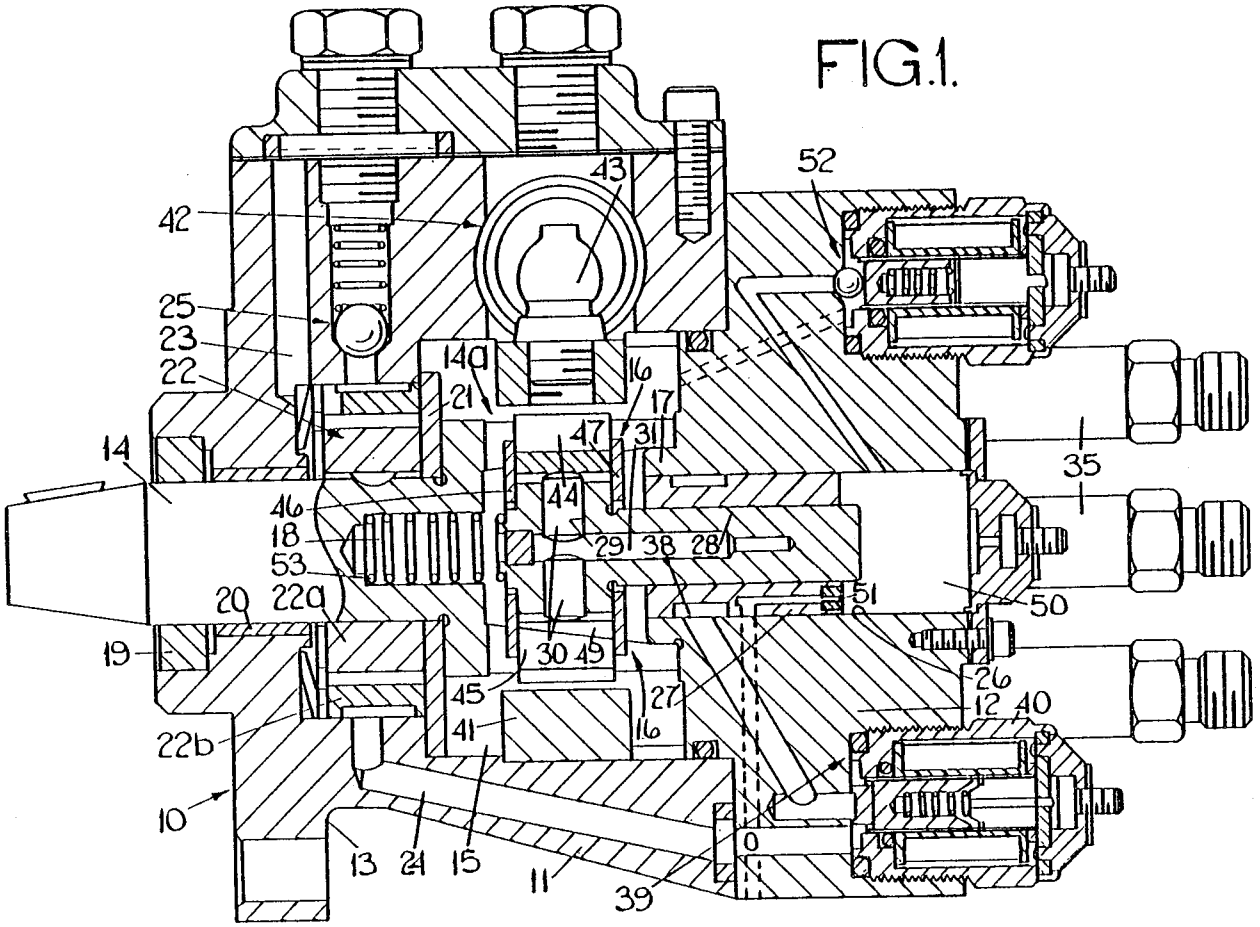
Figure 2:
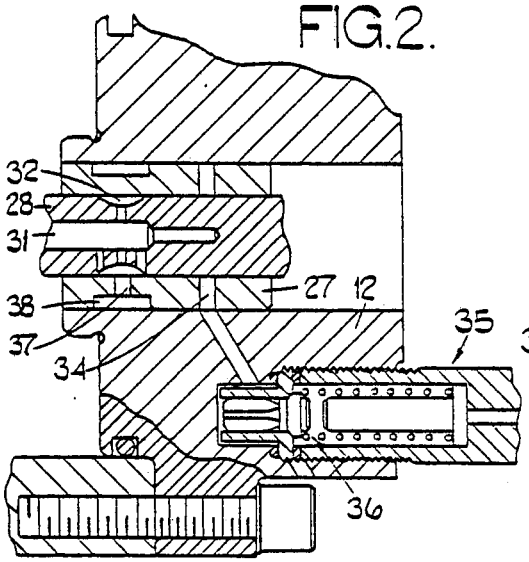
Figure 3:
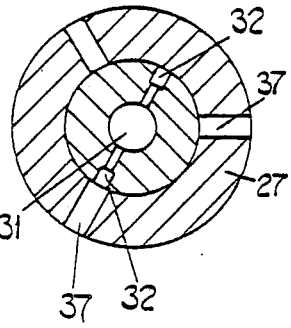
Figure 4:
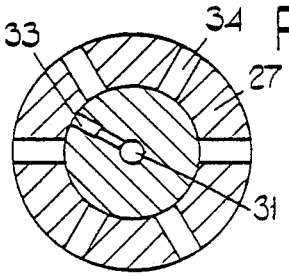
Figure 5:
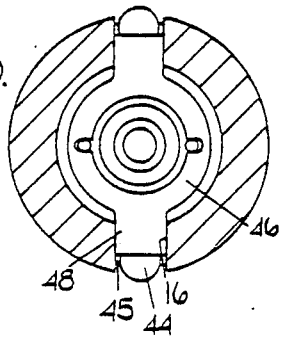
Figure 6:
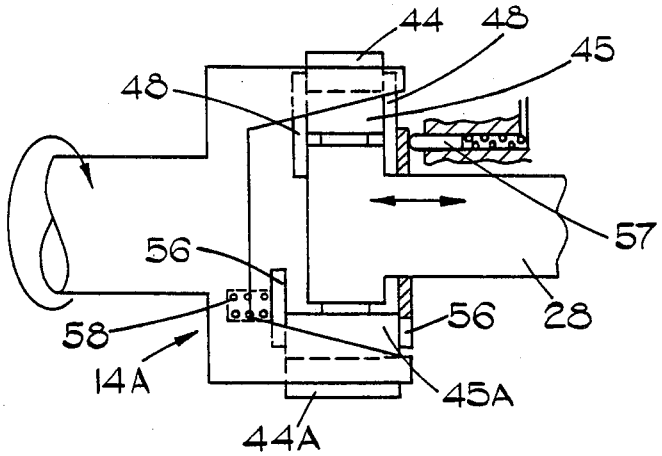
Figure 7:
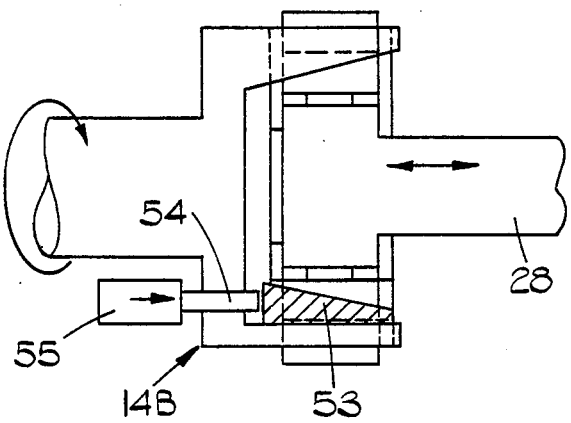

In the accompanying drawings;

FIG. 1 is a sectional side elevation of a known form of the apparatus to which the invention may be applied, FIG. 2 is a section of a part of the apparatus seen in FIG 1 taken along a different radial plane, FIGS. 3 and 4 are sections through parts of the apparatus as seen in FIGS. 1 and 2, FIG. 5 is a section through part of the apparatus seen in FIG. 1, FIG. 6 is a diagrammatic view showing one way of modifying the apparatus to achieve the object of the invention and FIG. 7 is a similar view to FIG. 6 showing a further example.

Referring to FIG. 1 of the drawings, the apparatus comprises a body part generally indicated at 10 and which conveniently is formed by a generally cup-shaped portion 11, which may be formed from a light alloy the open end of which is closed by a closure portion 12, this being formed from steel. The body portion 10 is provided with apertured lugs 13 whereby in use the apparatus can be secured to the engine with which it is associated.

The body portion 11 mounts a rotary drive shaft 14 which in use, is coupled to a drive member of the associated engine so that the drive shaft is rotated in synchronism with the engine. The drive shaft 14 extends into the generally cylindrical chamber 15 defined by the two body portions and has an enlarged cup shaped portion **14*a* within the chamber. The enlarged portion is provided with a pair of diametrically disposed slots 16. The enlarged portion of the drive shaft is hollow and at its end remote from the smaller diameter portion of the shaft the inner surface is of right cylindrical form and locates about a spigot portion 17 defined by the body portion 12. The remainder of the interior surface of the enlarged portion of the drive shaft tapers for a purpose which will be described. Moreover, the drive shaft is provided with a counter bore 18. An oil seal 19 is provided at the outer end of the body portion 10 for engagement with the drive shaft 14 and a sleeve bearing 20 supports the shaft for rotation, the shaft being given additional support by the spigot 17. The shaft is located against axial movement by a thrust surface which engages with the end surface defined between the two portions of the shaft. The thrust surface is defined by an annualar plate 21 which surrounds the drive shaft and which additionally serves as an end closure for an low pressure fuel supply pump 22. The rotor 22*a* of the supply pump is carried by the drive shaft 14 and the rotor in turn carries vanes which co-operate within an eccentrically disposed surface on a stator ring 22*b* which is carried within a body portion 11. The low pressure pump has a fuel inlet 23 connected to a fuel inlet in a housing secured to the body portion 11 and a fuel outlet 24. Moreover, a relief valve 25** is provided to ensure that the output pressure of the pump remains within desired limits, the relief valve being connected between the inlet and the outlet.

Formed in the body portion 12 is a cylindrical bore 26 in which is fixed a sleeve 27. The sleeve 27 accommodates an angularly and axially movable distributor member 28 which projects into the chamber 15 and has an enlarged head portion lying within the chamber. Formed in the head portion of the distributor member is a transversely extending bore 29 in which is located a pair of pumping plungers 30. The bore 29 communicates with a blind passage 31 formed in the distributor member and which at its end within the head portion is sealed by means of a plug. As is more clearly shown in FIGS. 2, 3 and 4 the passage 31 communicates with a pair of diametrically disposed longitudinal slots 32 formed in the periphery of the distributor member and communicating with the passage 31 by means of a single or a plurality of connecting passages. The passage 31 also communicates with a further longitudinal slot 33 formed in the periphery of the distributor member and this slot communicates in turn with a plurality of outlet ports 34 formed in the sleeve 27 and as seen in FIG. 2, the outlet ports 34 communicate with outlets 35 respectively in the body portion 12. Each outlet incorporates the usual form of delivery valve 36. The slots 32 register in turn with inlet ports 37 formed in the sleeve 27 and communicating with a circumferential groove 38 formed in the periphery of the sleeve. The groove 38 as shown in FIG. 1, communicates with the outlet 24 of the low pressure pump 22 by way of an on/off valve 39 conveniently controlled by an electromagnetic device 40. If desired a single slot 32 may be provided with the number of inlet ports being equal to the number of outlets.

Surrounding the head portion of the distributor member 28 is an annular cam ring 41 on the internal peripheral surface of which are formed pairs of diametrically disposed cam lobes. In the particular example three pairs of lobes are provided since the apparatus is intended to supply fuel to a six cylinder engine. Moreover, the cam ring 41 is angularly movable about the axis of rotation of the distributor member by means of a fluid pressure operable device generally indicated at 42 and connected to the cam ring by way of a radially disposed peg 43. The device 42 conveniently includes a resiliently loaded piston housed within a cylinder to one end of which liquid under pressure can be supplied to act on the piston to urge the piston against the action of its resilient loading.

Positioned at the outer ends of the plungers are a pair of followers respectively each of which comprises a roller 44 carried in a shore 45. The followers are retained axially relative to the distributor member by a pair of side plates 46, 47 which are secured to the side faces of the head portion of the distributor member. Conveniently as shown in FIG. 5, the side plates are of annular form and have a pair of outwardly extending tongues 48, which locate in the slots 16 formed in the enlarged portion of the drive shaft. In FIG. 5 the plate 46 is seen and the plates act to transmit rotary motion to the distributor member from the drive shaft. The shoes 45 are also located within the aforesaid slots 16 and the rotary motion is transmitted to the shoes directly by the drive shaft. Moreover, the circumferential side faces of the shoes are provided with circumferentially extending projections 49 the radially outer surfaces of which are tapered to co-operate with the tapered surface formed on the internal surface of the enlarged portion of the drive shaft 14, said surfaces forming the aforesaid complementary surfaces.

In use, when fuel is supplied to the bore 29, upon registration of a groove 32 with an inlet passage 37, the plungers 30 are moved outwardly by the fuel pressure and in so doing impart outward movement to the shoes 45 and the rollers 44. The outward movement is limited by the abutment of the tapered surfaces on the shoes and shaft and by moving the distributor member axially the extent of outward movement can be varied. Thus the amount of fuel supplied to the bore 29 can be controlled and this in turn determines the amount of fuel delivered through an outlet when the plungers 30 are moved inwardly by a pair of cam lobes.

The axial position of the distributor member can be varied mechanically or hydraulically. In the arrangement described the variation is achieved by varying the pressure within a chamber 50 defined by the end of the bore 26 in the body portion 12. The end of the bore 26 is closed by a closure member and fuel under pressure is supplied to the chamber 50 by way of a restricted orifice 51 carried by the sleeve 27. The orifice communicates with the outlet 24 of the pump 22. Fuel is allowed to escape from the chamber 50 so that the pressure in the chamber can be controlled, by way of an electromagnetically controlled valve 52. Moreover, the distributor member is biassed by means of a coiled compression spring 53 which is housed within the blind bore 18 formed in the drive shaft 14. The spring 53 acts between the drive shaft and the distributor member and urges the distributor member against the action of fuel under pressure in the chamber 50 which acts on the distributor member.

By varying the pressure in the chamber 50 using the valve 52, the axial position of the distributor member can be varied and therefore the amount of fuel delivered each time the plungers move inwardly can be varied.

For a given axial setting the distributor member and ignoring leakage, the amount of fuel delivered by the plungers will remain the same through the speed range of the associated engine and an indication of the axial setting of the distributor member, is provided by a transducer not shown.

Turning now to FIG. 6, in order to provide a reduced initial rate of fuel delivery one of the cam followers is axially movable. In the example it is the lower cam follower which comprises the roller 44A and the shoe 45A. The shoe 45A and also the roller 44A have an increased axial length and the aforesaid side plates 46, 47 are modified to allow the cam follower to be moved axially while the apparatus is in operation. The aforesaid complementary surfaces are still operative to limit the extent of outward movement of the associated plunger but for example as the cam follower is moved towards the right relative to the distributor member, the associated plunger will move further in the outward direction before it is brought to rest, than the other plunger and hence it will be moved inwardly before the other plunger to give the reduced initial rate of delivery of fuel. The axial position of the cam follower relative to the distributor member will determine the amount of fuel delivered at the reduced rate.

Turning now to FIG. 7 both followers are the same and as described with reference to FIG. 1. In this case however the cup shaped portion 14B of the drive shaft is modified by having a portion of its internal tapered surface defined on a member 53 which is mounted for axial movement relative to the remainder of the cup shaped portion. The member 53 defines inclined surfaces for co-operation with the inclined surfaces on the associated shoe 45. The axial setting of the member 53 relative to the cup shaped portion 14B can be determined by a speed responsive device 55 which sets the position of the member through the intermediary of a peg 54 slidable in an axially extending aperture in the base wall of the cup shaped portion.

In the above modification the adjustment of the axial setting of the follower for a given setting of the distributor member alters the amount of fuel delivered by the apparatus and hence adjustment of the axial setting of the distributor member will be required in order to maintain the amount of fuel delivered constant.

With the arrangement described one roller will engage the cam ring before the other and the cam ring will therefore be subject to a radial force this force persisting until the other roller engages a cam lobe. This could cause considerable wear to the engaging surface of the cam ring and surrounding body. In a practical arrangement therefore the plungers would be arranged in opposed pairs so that in total, there would be four plungers. The forces acting on the cam ring would be balanced and the wear of the contacting surfaces of the cam ring and body minimized.

In the arrangement shown in FIG. 6 the axial setting of the roller 44A and shoe 45A is adjusted by means of a fluid pressure operable piston 57 which is housed within a cylinder formed in the body part of the apparatus. The roller and shoe are located between a pair of side plates 56 and the piston 57 is lightly spring loaded into contact with one side plate to assist the action of the fluid pressure applied to the piston. The movement of the side plate 56 by the piston is opposed by a stronger spring or springs 58 housed within a recess or recesses in the cup shaped portion 14A. It will be appreciated that in the practical construction the plates 56 extended diametrically across the distributor member.

In the arrangement shown in FIG. 7 the peg or pegs 54 are adjusted by a speed responsive mechanism 55 which acts on the pegs through a pressure ring not shown. The mechanism 55 may be a fluid pressure operable piston responsive to a fuel pressure derived from the output pressure of the fuel supply pump 22.

I claim:

1. A liquid fuel injection pumping apparatus for supplying fuel to an internal combustion engine comprising a body part, a rotary distributor member mounted in the body part and arranged in use to be driven in timed relationship with the associated engine, bores formed in the distributor member, plungers in said bores respectively, cam followers positioned at the outer ends of said plungers respectively for engagement with cam lobes formed on the internal surface of a cam ring surrounding the distributor member, the cooperating surfaces of the cam followers and the cam ring being complemental and shaped such that outward movement of the plungers is controlled according to both the axial and radial positions of the cam followers with respect to the cam ring with a first axial position of the cam followers relative to the cam ring permitting outward movement of the plungers during a filling stroke farther than outward movement of the plungers permitted when the cam followers are in a second axial position relative to the cam ring with plungers associated with cam followers in the first axial position moving inwardly before plungers associated with cam followers in the second axial position, passage means for conveying fuel to and from said bores during rotation of the distributor means, the complementary surfaces on the followers and a portion rotatable with the distributor member limiting the outward movement of the plungers, means for adjusting the axial setting of the distributor member within the body part whereby the amount of fuel which can be delivered by the apparatus during inward movement of the plungers can be varied, adjusting means for reducing the initial rate of fuel delivery by reducing the number of plungers delivering initial flow, comprising moving means to adjust the axial position of less than the total number of the cam followers with respect to the cam ring in said first axial position while leaving the axial position of the remaining cam followers with respect to the cam ring unchanged in the second axial position, said adjusting means including means responsive to the speed of operation of the apparatus of activating said moving means.

2. An apparatus according to claim 1 in which the cam follower is movable by said further means relative to the distributor member and comprises a shoe mounting a roller.

3. An apparatus according to any one of claims in which said adjusting means comprises a fluid pressure operable piston.

* * * * *